US010457356B2

(12) United States Patent
Warnan et al.

(10) Patent No.: US 10,457,356 B2
(45) Date of Patent: Oct. 29, 2019

(54) METHOD FOR HANDLING A FAIRED CABLE TOWED BY A VESSEL

(71) Applicant: THALES, Courbevoie (FR)

(72) Inventors: François Warnan, Plouzane (FR); Dominique Durand, Plistin (FR); Jean-Philippe Longuet, Brest (FR); Marc Lazzarini, Antibes (FR); Stéphane Autret, Terrasson Lavilledieu (FR); Jean-Jacques Lossec, Brest (FR); Philippe Prost, Bagnols en Foret (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 15/553,031

(22) PCT Filed: Feb. 26, 2016

(86) PCT No.: PCT/EP2016/054146
§ 371 (c)(1),
(2) Date: Aug. 23, 2017

(87) PCT Pub. No.: WO2016/135321
PCT Pub. Date: Sep. 1, 2016

(65) Prior Publication Data

US 2018/0029671 A1 Feb. 1, 2018

(30) Foreign Application Priority Data

Feb. 27, 2015 (FR) ..... 15 00385

(51) Int. Cl.

| | |
|---|---|
| ***B63B 21/66*** | (2006.01) |
| ***B66D 1/40*** | (2006.01) |
| ***B66D 1/48*** | (2006.01) |

(52) U.S. Cl.
CPC ..... *B63B 21/663* (2013.01); *B66D 1/40* (2013.01); *B66D 1/48* (2013.01); *B63B 2708/00* (2013.01)

(58) Field of Classification Search
CPC . B63B 21/66; B63B 21/663; B63B 2021/666; B63B 2708/00; B63B 2708/02;
(Continued)

(56) References Cited

U.S. PATENT DOCUMENTS 3,347,526 A 10/1967 Thomas et al.
4,055,138 A * 10/1977 Klein ..... B63B 21/66 114/244

(Continued)

FOREIGN PATENT DOCUMENTS

| | | | |
|---|---|---|---|
| CA | 988 501 | A | 5/1976 |
| CA | 2909164 | C | 12/2014 |
| DE | 10 2013 105593 | A1 | 12/2014 |

*Primary Examiner* — Andrew Polay
(74) *Attorney, Agent, or Firm* — Baker & Hostetler LLP

(57) ABSTRACT

A method for handling a cable that is faired by means of a fairing, the cable towed by a ship on board which there is a winch allowing the faired cable to be wound in and paid out through a faired-cable guide device, the method comprises: a first step of monitoring the cable, making it possible to detect whether the fairing is experiencing a double twist around the cable comprising an immersed full twist and an airborne full twist, and, when a double twist is detected, a first step of hauling in the faired cable, during which step the faired cable is hauled in, the first hauling step being carried out in such a way that the immersed full twist at least partially leaves the water and does not enter the guide device.

18 Claims, 4 Drawing Sheets

(58) Field of Classification Search
CPC .. B63B 21/16; B66D 1/00; B66D 1/28; B66D 1/40; B66D 1/48; B66D 1/485; B66D 1/50; B66D 1/505; B66D 1/52; B66D 1/525
See application file for complete search history.

(56) References Cited

U.S. PATENT DOCUMENTS

| | | | | |
|---|---|---|---|---|
| 4,597,352 | A | 7/1986 | Norminton | |
| 5,199,659 | A * | 4/1993 | Zibilich, Jr. | B63B 21/66 242/470 |
| 6,811,112 | B1 * | 11/2004 | Currie | B65H 54/2872 242/157.1 |

* cited by examiner

METHOD FOR HANDLING A FAIRED CABLE TOWED BY A VESSEL

CROSS-REFERENCE TO RELATED APPLICATIONS

This application is a National Stage of International patent application PCT/EP2016/054146, filed on Feb. 26, 2016, which claims priority to foreign French patent application No. FR 1500385, filed on Feb. 27, 2015, the disclosures of which are incorporated by reference in their entirety.

FIELD OF THE INVENTION

The present invention relates to faired towing cables used on ships for towing a submersible body launched at sea and to the handling of these cables. It relates more particularly to towing cables which are faired using fairing elements articulated to one another.

The context of the invention is that of a naval vessel or ship intended to tow a submersible object such as a variable-immersion sonar incorporated into a towed body. In such a context, in the non-operational phase, the submersible body is stored on board the ship and the cable is wound around the drum of a winch used for winding in and paying out the cable, namely for deploying and recovering the cable. Conversely, in the operational phase, the submersible body is submerged behind the ship and towed by the latter using the cable, of which the end connected to the submersible body is immersed. In other words, during the operational phase, the cable is deployed, it is towed by the ship and has one end immersed. The cable is wound in by the winch through a guiding device that allows the cable to be guided. The guiding device makes it possible to limit the lateral excursion of the cable. It conventionally comprises a pulley.

BACKGROUND

In order to obtain a high degree of immersion at high towing speeds, the towing cable is faired to reduce its hydrodynamic drag to a very large extent. FIG. 1A depicts a portion of the cable 1 extending along an axis x. This cable is faired, namely covered with fairing elements having shapes intended to reduce the hydrodynamic drag. The fairing elements form a fairing also referred to as a fairing string. The fairing elements are rigid. In other words, they do not deform under the effect of the hydrodynamic flow. The cable 1 is conventionally faired by means of a fairing or fairing string 3 comprising a series of fairing elements 2 or fairings. Each fairing element 2 comprises an elongate element exhibiting a hydrodynamic profile. The hydrodynamic profile is the shape of a cross section of the fairing portion in a plane perpendicular to the axis x. The hydrodynamic profile of the fairing elements is, for example, as depicted in FIG. 1B, in the shape of a wing having a thick internal edge (or leading edge BA) housing a tubular canal through which the cable 1 passes and a thin external edge (or trailing edge BF) allowing a less-turbulent flow of the water around the cable. The hydrodynamic profile exhibits, for example, a teardrop shape or is an NACA profile which is a profile defined by the National Advisory Committee for Aeronautics, NACA. The collection of fairing elements completely or partially covers the cable. The fairing elements are immobilized translationally with respect to the cable along the axis x.

In the normal operating state, the fairing elements are mounted with the ability to rotate about the cable, namely about the axis x. However, each fairing element is connected to its two neighbors in such a way as to be able to pivot with respect to these about an axis parallel to the axis x by a maximum angle that is small, of the order of a few degrees. This is because it is necessary for the fairing elements to be able to rotate freely about the cable so as to be correctly orientated in the various phases because it is not possible to control the orientation of the cable itself; these phases are: orientation according to the stream of the water, orientation in order to pass through the pulleys, reeling, of the guide device and storage on the drum. As a result, the rotation of one scale leads to a rotation of the neighboring fairing elements and so on and so forth through the entire set of fairing elements. Thus, both when the cable is deployed in the water and when it is wound around the drum, any change in orientation of one of the fairing elements has a knock-on effect on all of the fairing elements fairing the cable. Thus, when the cable is deployed at sea, the fairing elements naturally oriented themselves in the direction of the current generated by the movement of the vessel. Likewise, as the cable is wound around the drum of the winch, all the fairing elements, as the cable is raised, adopt one and the same orientation relative to the drum, which orientation allows the cable to be wound in keeping the fairing elements parallel to one another turn by turn.

Now, the applicant company has found that, when the cable is wound around the drum so as to recover the towed body, the fairing sometimes becomes severely damaged or even crushed as it passes through the guide devices, this being something which may render the entire sonar system unavailable. It may even happen that this damages the guide device. By way of example, certain variable-immersion sonar systems installed on certain ships and operated in the normal way by military crews encounter fairing-element-crushing problems approximately once a year and sometimes far more frequently. This situation causes the system to become unavailable for a period which may range from a few hours to a few months, during which maintenance operations have to be carried out.

SUMMARY OF THE INVENTION

It is an object of the present invention to propose a cable handling method that makes it possible to limit the risks of damage to the fairing of a towed cable so as to limit the risks of the sonar system becoming unavailable.

To this end, the applicant company has first of all, in the context of the present invention, identified and studied the cause of this problem of the fairing elements becoming crushed by observing the faired cable in an operational situation and by modeling the faired cable in an operational situation and by modeling the various forces acting on it, notably the hydrodynamic and aerodynamic flows, and the force of gravity.

During the operational phase, the faired cable is towed by the ship and has one end immersed. Very often, the tow point is a point on a pulley which is situated a certain height above the water. What is meant by the tow point is the position of the point at which the cable bears against a device on board the ship, which is closest to the immersed end of the cable. As the ship moves forward, under the action of drag the cable moves away from the transom to disappear beneath the water a little further afield than a point vertically below the tow point. The length of faired cable that is airborne is increased in comparison with the simple height of towing above the waterline because the cable is inclined with respect to the vertical. It is found that the last fairing element still engaged with the ship, namely the fairing element which is at the tow point, often resting on the pulley or resting on a guiding device on board the ship, is oriented correctly in the direction of the flow even though it is considerably higher up in the air (leading edge facing into the flow and trailing edge trailing). The first fairing element in the water (namely the fairing element that has just been immersed) is assumed to adopt a correct orientation in the flow stemming from the speed of the ship (leading edge facing into the flow and trailing edge trailing). However, between these two remarkable fairing elements, the string of fairing may twist because, in the air, it is subjected only to vibrations, to an insignificant flow of air and to the effect of gravity. Under the effect of the influences of the sea, of the towing conditions and of the waves, situations whereby this airborne string twists are regularly observed. The first cause of twisting is the effect of gravity as soon as the cable moves away from the vertical, something which it has to do as soon as the towing speed becomes sufficient. Under the effect of gravity, the string of fairing between the tow point and the sea will twist to one side (in the air) and then straighten up (in the water). This is the nominal situation of the string of fairing. This twist is dependent on the intrinsic stiffness of the string of fairing and also on the length airborne. A situation in which the airborne part of the fairing 2 is a little twisted, namely experiences torsion about the axis x, is depicted in FIG. 2A. In FIG. 2A, the vertical direction in the Earth's frame of reference is represented by the axis z and the orientation of the section of certain fairing elements in zones A, B and C delimited by dotted line has been depicted. In the situation depicted in FIG. 2A, the last fairing element 3, which is engaged with the ship, is oriented vertically (trailing edge uppermost) as depicted in zone A. The fairing elements that are in the air between the pulley P and the water surface S are lying down under the effect of gravity. In other words, as visible in zone B, the trailing edge of the fairing elements is oriented downward (between the pulley P and the water surface S, the fairing elements have rotated about the cable). By contrast, the fairing elements that are in the water have straightened up under the action of the flow of water acting in the direction of the arrow FO as depicted in zone C (trailing and leading edge both situated at approximately the same depth).

Occasionally, depending on the sea conditions, with green seas or crashing waves breaking more or less over the transom of the ship, the airborne part of the cable temporarily experiences flow in the opposite direction to that prevailing lower down and which corresponds to the speed of forward travel of the ship. These packets of water are perfectly capable of twisting the string of fairing still further and of placing it in opposition with the position expected in the normal towing stream. When that happens, the fairing is twisted and makes a half-turn about the cable in its airborne part. That means that two fairing elements of the airborne part of the string of fairing have trailing edges that between them form an angle of 180 degrees around the cable. The part of the fairing situated between these two fairing elements is twisted or in torsion. Starting out from this situation, it may happen that these parts of fairings which are therefore the wrong way round with respect to the mean stream imposed by the speed of the ship then suddenly find themselves immersed in this mean stream again (because of the movements of the ship, that of the waves, etc.) so the part of the fairing that is the wrong way round is therefore urged to return to the right direction (the direction associated with the normal mean stream). It may then:

cancel its half-turn and return to its initial position by making the opposite rotation to the rotation that led it to become the wrong way round. It then finds itself correctly oriented;

or add to the existing half-turn a further half-turn which returns it to the correct orientation in the stream but has the effect of twisting the airborne part of the fairing above it by 1 turn (or 360°) and of similarly twisting a portion below it by one turn (or 360°, but this time in the other direction). The part which was initially the wrong way round has returned to the correct orientation in the main stream associated with the speed of the ship, but this has resulted in two twistings by one turn, one of the above it in the air and the other below it in the water. The name given to this is a full twist of the fairing. This full twist is a stable situation of the string of fairing or of the fairing 2. It is depicted in FIG. 2B. This situation may be described as follows: between the tow point R and the water surface S, the string of fairing makes a full turn in the direction of the arrow F1 about the cable. The string of fairing 2 passes through the surface S and remains correctly oriented over a certain length L1 of a few meters or sometimes less. The string of fairing 2 then makes a complete revolution in the water, in the opposite direction, depicted by the arrow F2, to return to the correct orientation in the stream. In other words, the fairing undergoes a double full twist about the cable. The double twist comprises an airborne full twist TA, situated above the water surface and an immersed full twist TI situated below the water surface. All of the part of the fairing that is situated below this double full twist is now completely unaffected by what happens above it (its fairing elements are correctly oriented in the stream).

The configuration in which the fairing undergoes a double twist is stable but highly degraded and carries a high risk of subsequently introducing a great deal of disturbance into the entire system.

The applicant company has discovered that it is when a fairing experiences a complete double twist that, under certain conditions, the fairing will become very much deteriorated in the water and this deteriorated part will cause a great deal of damage to the entirety of the faired system as the cable is being wound in and, more specifically, as it passes through the cable guiding device. More specifically, the damage will consist mainly in breakage of connections between adjacent fairing elements.

By analyzing the complete double twist, the applicant company has found that the submerged twist can be considered to be "caught" on the cable. In other words, the position of the submerged twist is fixed with respect to the cable along the axis of the cable. By contrast, its airborne counterpart, the airborne twist, remains situated at the same point between the tow point R and the water surface S. It is not fixed with respect to the cable along the axis of the cable but fixed with respect to the water surface S or to the tow point. When the cable is hauled in or lowered, the fairing elements experiencing the submerged twist follow the movement of the cable which is being hauled in or lowered, while the airborne twist remains fixed with respect to the water surface. From this it follows that a paying-out of the cable causes the submerged twist to sink to a greater depth while the airborne twist remains in the same place with respect to the water surface (so the 2 twists move further apart). FIG. 2C depicts a situation in which the cable has been paid out with respect to the situation of FIG. 2B (see arrow). The distance L2 represents the distance between the part of the fairing affected by the submerged twist and the point at which the fairing enters the water is greater than the distance L1 which represents this same distance in the situation of FIG. 2B. Conversely, a hauling-in of the cable, with respect to the situation of FIG. 2B, in the direction of the arrow represented in FIG. 2D, causes the submerged twist to rise while the airborne twist still remains in the same place with respect to the water surface (so the two twists move closer together).

It is then necessary to examine what happens for a twist of one turn that is immersed and towed in that state. This twist which deploys over a small height forces the fairing to travel backwards or across the stream. The action of the stream on these fairing elements is therefore very great (proportional to the surface area, angle, density of the water and the square of the speed). This action manifests itself in the form of powerful torsional moments which tend to force the fairing elements to align in the stream but they come up against the stiffness of the turn of twist which therefore increases. What happens then is that a balance is struck and that the one-turn twist finds itself very much restricted in height and the fairing experiences violent loadings which, as has been seen, result in very great deformations. The formation of a double twist may lead to deterioration of the immersed twist. Specifically, when a double twist has formed, it will tighten under the effect of the towing speed. In other words, the full turn of the fairing about the cable will take place over an ever-shortening distance. Observations at sea have shown that the string of fairing could effect one full turn around the cable over a length of 50 cm. The hydrodynamic stream applies a very high torque to the incorrectly oriented fairing elements. The length of time for which the fairing is exposed to this submerged twist and towed will gradually lead to deformations that are permanent (or very slow to be reabsorbed), making it completely unable, for a fairly long period of time, to engage in the cable guide device even though the continuity of the fairing is unbroken. Another effect of this very high hydrodynamic torque is simply that of definitively breaking the continuity of the fairing string. On the airborne twist side there is no damage, although there is a twist applied it is not at any time capable of damaging the cable.

By contrast, if the length of exposure of an immersed twist to the towing flow is short or if the towing speed is low, the twist will retain no memory of its deformation. The following is what will then happen if the cable is then hauled in: The immersed twist would be raised at the same time as the cable, it would reach the surface and encounter the airborne twist and, at that moment, the two twists would cancel one another out and disappear together. But the same would not be the case if the violent deformation of the immersed twist were to endure.

The applicant company has therefore observed that when raising an immersed twist which is not reabsorbed because it is long-standing, the fairing has been under great stress for a long time, it has retained memory of its deformation and the immersed twist leaves the water still very tightly twisted during hauling-in and does not disappear during the hauling-in. When the still very tightly twisted immersed twist then arrives at the guide device, for example the pulley, the fairing elements affected by this immersed twist are unable to position themselves correctly in the pulley because the pulley limits the lateral excursion and also because in general the pulley has a tight groove intended to hold the fairing elements with the leading edge facing upward so as to facilitate the winding of the cable without damage onto the winch. It acts like a shaper. The fairing elements pass in a direction other than that depicted in FIG. 2*a* through the pulley and go so far as to pass through the pulley the wrong way round, become jammed, and it is then the entire fairing string that comes after the part of the fairing affected by the old immersed twist that becomes methodically destroyed if hauling-in continues because each fairing element will, from one to the next, follow the orientation of the fairing element before it.

The invention proposes a cable handling method which is based on this study of the double twist phenomenon and which makes it possible to limit the risks of damage to the cable fairing.

To this end, one subject of the invention is a method for handling a cable that is faired by means of a fairing, said cable being towed by a ship on board which is there is carried a winch allowing the faired cable to be wound in and paid out through a faired-cable guide device, the method comprising:

a first step of monitoring the cable making it possible to detect whether the fairing is experiencing a double twist around the cable comprising an immersed full twist and an airborne full twist, and, when a double twist is detected, a first step of hauling in the faired cable, during which step the faired cable is hauled in, the first hauling step being carried out in such a way that the immersed full twist at least partially leaves the water and does not enter the guide device.

Advantageously, the method comprises at least one of the following features considered alone or in combination:

the first hauling step comprises a step of raising the cable, during which step the tow point of the cable is raised using a lifting device carried on board the ship, when the double twist is not reabsorbed at the end of the raising step, the method comprises a step of winding the cable in using a winch carried on board the ship, the first monitoring step is performed constantly or is repeated at time intervals shorter than a threshold duration ds at most equal to 10 minutes, a duration d separates the detection of the double twist and the start of the first step of hauling of the cable, the sum of the threshold duration ds and of the duration separating the performance of the first monitoring step at the moment of detection and the previous implementation of the first monitoring step is at most equal to 15 minutes, the first hauling step is performed at least until the detected double twist is reabsorbed, the method comprises a first monitoring step making it possible to detect a double twist of the fairing which step is performed before each second hauling step during which the cable is wound in, by means of the winch, by a length L greater than or equal to the sum of 1 meter and the altitude separating the tow point from the water surface, the first hauling step is performed at least partially by means of a winch at the nominal speed of the winch, the method comprising, when the double twist is not reabsorbed during the first hauling step, and if the winding-in of the length L of cable involves the immersed twist passing through the guide device, a third step of hauling the cable during which step the immersed twist belonging to the detected double twist passes through the guide device, the third hauling step being performed by means of the winch at a hauling speed lower than the nominal speed, the third hauling step is manually or mechanically assisted so as to position the fairing correctly in the guide device, the hauling of the cable is halted at the end of the first hauling step until the double twist is reabsorbed, when the double twist is reabsorbed during the first hauling step, the first hauling step is followed by a final hauling step performed by means of the winch at the nominal speed of the winch until the length of cable wound in by means of the winch reaches the length L, the method comprises, when no double twist is detected during the first monitoring step, a second step of hauling the cable in by a length L, which step is performed by means of a winch at the nominal speed of the winch, the method comprises a second monitoring step performed during the first hauling step and making it possible to detect the reabsorption of the double twist and to monitor the position of an immersed full twist relative to the guide device, the method comprises fourth steps of hauling the cable during which steps the cable is wound in by respective lengths less than the sum of 1 meter and the altitude separating the tow point from the water surface, the fourth hauling steps being performed at respective time intervals greater than or equal to 20 minutes at least during a predefined period, the cable not being paid out between two consecutive implementations of the fourth step, the method comprises a fifth hauling step consisting in winding the cable in by a length less than the sum of 1 meter and the altitude separating the tow point from the water surface, to the length prior to at least one step of paying out the cable, the first hauling step is performed by means of a hauling device, said hauling device being activated automatically when the monitoring device detects a double twist.

Another subject of the invention is a device for handling a cable that is faired by means of a fairing and towed by a ship, said device comprising a monitoring device making it possible to detect whether the fairing is experiencing a double twist around the cable comprising an immersed full twist and an airborne full twist, and a hauling device allowing the cable to be hauled in when a double twist is detected so that the immersed full twist at least partially leaves the water and does not enter the guide device.

Advantageously, the device comprises an activation device allowing hauling by the hauling device to be activated, and control means allowing the hauling of the cable to be controlled in such a way that the immersed full twist at least partially leaves the water and does not enter the guide device.

Advantageously, the device comprises an alert device allowing an operator to be alerted when a double twist is detected.

The invention also relates to a handling device configured to implement the method according to the invention, the monitoring device being configured to detect whether the fairing is experiencing a double twist about the cable comprising an immersed full twist and an airborne full twist and the hauling device being configured to implement the first hauling step when a double twist is detected by the monitoring device.

Advantageously, the handling device comprises an actuator configured to activate the hauling of the cable by means of the hauling device when a double twist is detected by the monitoring device, and a controller allowing the hauling of the cable by means of the hauling device to be controlled in such a way that the immersed full twist at least partially leaves the water and does not enter the guide device.

BRIEF DESCRIPTION OF THE DRAWINGS

Other features and advantages of the invention will become apparent on reading the detailed description which follows, given by way of non-limiting example and with reference to the appended drawings in which.

From one figure to another, the same elements bear the same references.

DETAILED DESCRIPTION

The invention relates to a method for handling a faired cable 1 towed by a naval vessel, such as a ship, allowing the fairing of the cable to be protected.

Figure 3:
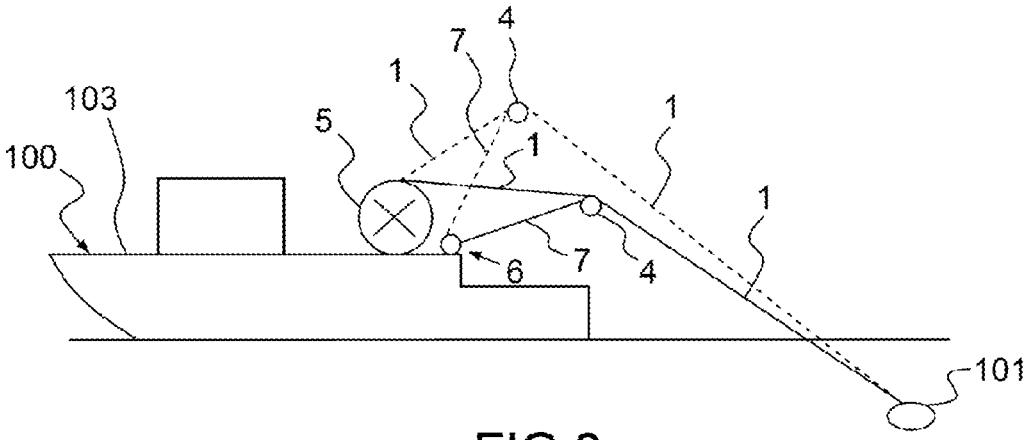
FIG. 3 depicts a ship towing a towed object by means of a towing cable.

FIG. 3 depicts a cable 1 that may be a towing or electrically hauling cable towed by a ship 100. The cable 1 is towed or pulled by a ship. It is at least partially immersed. The cable comprises a fairing 3 comprising at least one fairing portion comprising a plurality of fairing elements 2. The fairing elements of one and the same fairing portion are joined together axially, namely along the towing cable. They are mounted with the ability to pivot about the cable and articulated to one another by means of a coupling device so that relative rotation of said fairing elements 2 with respect to one another about the cable 1 is allowed. This excursion is permitted either freely with a stop. The rotation of one fairing element about the cable therefore does not cause the adjacent fairing element to turn. The excursion may be achieved in a constrained manner, with more or less strong return toward the aligned position (position of no relative rotation of the fairing elements relative to one another about the cable). In the latter instance, rotation of one fairing element about the cable causes the adjacent fairing elements of the same portion to rotate about the cable. When the fairing comprises several portions, the portions are free to rotate relative to one another about the cable. In the conventional way, the fairing elements of one fairing portion are connected in pairs by individual coupling devices. Each coupling device allows a fairing element to be connected to another, adjacent, fairing element of the same fairing portion only.

The cable tows a towed body 101, for example comprising one or more sonar antennas. The towed body 101 is mechanically anchored to the cable 1 in an appropriate manner. The towed body 101 is put into and removed from the water by means of a winch 5 arranged on a deck 103 of the ship 100. The winch 5 comprises a drum, not depicted, dimensioned to allow the winding of the cable 1. The towed cable 1 may be wound around the winch 5 through a guide device 4, as described hereinabove, allowing the cable to be guided. The cable guiding device also, in the conventional way but not necessarily, allows the fairing elements to be orientated with respect to the drum of the winch. Is also makes it possible, in the conventional way, to safeguard the radius of curvature of the cable so that this does not drop below a certain threshold. In the nonlimiting example depicted in FIG. 3, the guide device is a pulley 4. It could, for example, comprise, in place of or in addition to the pulley, at least one guide means or guide making it possible to limit the lateral excursion of the cable, such as a deflector, a fairing-element turner, a fairlead to safeguard the radius of curvature of the cable so that this does not drop below a certain threshold, and/or a reeling device so that the cable can be stowed correctly on the drum In the embodiment of FIG. 3, a lifting device 6 is carried on board the ship 100 to allow the tow point to be raised and lowered. It comprises, in the nonlimiting example depicted in FIG. 3, an articulated structure 7, for example an arm, to which the pulley 4 is fixed. The articulated structure 7 is able to pivot about an axis perpendicular to the plane of the figure, substantially parallel to the deck of the ship, namely an axis that is substantially horizontal when the ship is in equilibrium, so as to move from a low position, as depicted in solid line in FIG. 3, in which the pulley (or more generally the tow point) occupies a low position, into a high position (depicted in dotted line in FIG. 3) in which the pulley (or more generally the cable tow point) lies at a second altitude higher than the first altitude at which the pulley (or more generally the cable tow point) is situated in the low position with respect to the deck of the ship or with respect to the water surface. Therefore, when the articulated structure moves from its high position into its low position, that amounts to hauling in the cable or to raising the tow point so as to cause a length l of cable to exit the water without the cable advancing toward the guide device. Any other lifting device could be used for raising the cable tow point. Advantageously, the handling device is configured to allow a length of cable of between 1 m and 2 m to be raised out of the water.

The invention seeks to limit the risks that a part of the fairing experiencing an immersed full twist might enter the cable guide device.

To this end, the method for handling the cable 1 according to the invention comprises a first step of monitoring the fairing 1 making it possible to detect whether the fairing 2 is experiencing a double twist comprising an immersed full twist and an airborne full twist and, when a double twist of the fairing 2 is detected, a first step of hauling in the cable 1, consisting in hauling the cable 1 in, the first monitoring step and the first hauling-in step being carried out in such a way that the immersed twist at least partially leaves the water and does not enter the guide device.

In order to understand the effects of the method according to the invention, the effects of the first step of hauling the cable in following detection of a double twist need to be described. It has been seen that the immersed twist remains "attached to the cable", which means to say that the part of the fairing that is experiencing a full twist that is immersed or has been immersed occupies a fixed position with respect to the cable along the axis of the cable. Therefore, by hauling in the part of the cable that is experiencing the immersed twist (namely the fairing elements experiencing the immersed twist) it will therefore gradually rise toward the surface, whatever its immersion. When the immersed twist arrives above the water surface, the applicant company has found, by studying the double twist phenomenon, that the following two things may happen.

First, if the double twist is recent, which means to say if it has been formed in the last 15 minutes or less, the tightening twisting of the fairing string is instantaneously reversible. In that case, during the first step of hauling the cable, as soon as the first fairing elements which are incorrectly oriented as a result of the immersed twist begin to leave the water, or at worst when half of the part of the fairing affected by the immersed twist has left the water, the double twist finds itself destabilized and suddenly unwinds at the same time as the airborne twist. The fairing then finds itself free of this double twist and reverts to its nominal state and the system can once again be operated in the nominal way and, in particular, it is possible to reimmerse the part of the cable that was affected by the immersed twist or alternatively to wind it around the drum of the winch without the guide device becoming damaged.

Secondly, if the double twist is long-standing, namely if it was formed more than 15 minutes ago, during the first step of hauling of the cable, the double twist of the fairing does not unwind itself naturally (or there is the risk that it will not do so). This is because, if the double twist is long-standing, it has tightened. It then follows that even if the hydrodynamic force is released, the double twist will not unwind itself. It may do so after a certain length of time and following the relaxation of potential viscoelastic phenomena. Therefore, if the cable is hauled in too much, the remanent immersed full twist will arrive at the towing pulley or at the cable guide system at the tow point. In other words, that part of the cable that was immersed at the moment of detection of the double twist and about which the fairing was and still is experiencing a full twist is raised and will enter the guide device. The first hauling step is therefore performed in such a way that the part of the fairing experiencing the immersed full twist at the moment of detection of the double twist does not enter the guide device. Therefore, the method according to the invention makes it possible, when implemented, either to reabsorb a double twist or, when this is not reabsorbed, to avoid an immersed twist entering the guide device. The method according to the invention therefore makes it possible to limit the risks of damage to the fairing caused by the appearance of the double twists. The method of the invention does not require any modification to the device used for winding in and paying out the cable (winch and guide device). The method according to the invention is particularly advantageous when the guide device is too narrow for fairing elements which are not oriented with the trailing edge uppermost when they arrive at the guide device to be able to turn over by pivoting about the axis of the cable in order to reach this position. In other words, the guide device acts like a shaper.

One example of a first embodiment of the method according to the invention will now be described with reference to FIG. 4. In this embodiment, the first monitoring step 10 is performed constantly or frequently at least during the towing of the cable. In other words, the monitoring step is performed constantly either by an automatic system or by observations made by a member of the crew. In other words, the time separating two successive implementations or carryings-out of the monitoring step less than or equal to 10 minutes and preferably less than or equal to 5 minutes. What is meant by the towing of the cable 1 is a situation in which the cable has one end immersed and in which the ship is moving forward over the water. Although there are conditions that are fairly favorable to the appearance of double twists, there is absolutely no way of predicting when a double twist may occur. Constant or frequent monitoring of double twists therefore makes it possible to ensure that, when a double twist is detected, it is a recent one. Therefore a detected double twist will be automatically reabsorbed when the cable is hauled in by a sufficient length, namely when the immersed twist exits the water, at worst when around half the immersed twist has left the water. Furthermore, the applicant company has found that the immersed twist is formed not far from the surface, around 1 or 2 meters from the surface. The immersed twist therefore remains at that depth if the cable has not been paid out after the immersed twist has formed.

When a double twist is detected, a first step 11 of hauling of the cable 1, consisting in hauling the cable in, is performed. Advantageously, the first hauling step 11 is performed until the double twist is reabsorbed or, more generally, at least until the airborne twist is reabsorbed. The method according to the invention makes it possible, without modifying the towing device, to take account of the appearance of twists in order to reabsorb these without the risk of arriving at a situation in which the fairings become crushed. This method makes it possible to guarantee the disappearance of the crushing of part of the fairing string as a result of the formation of a double twist.

The time separating the start of the first hauling step and the detection of the double twist is less than or equal to a threshold duration ds The threshold duration ds is such that the sum of the threshold duration ds and of the duration separating the performance of the first monitoring step at the moment of detection and the previous implementation of the first monitoring step is at most equal to 15 minutes, and preferably at most equal to 10 minutes. The duration separating the performance of the first monitoring step at the moment of detection and the previous implementation of the first monitoring step is zero when the first monitoring step is performed constantly. In practice, the duration ds is comprised between 5 and 10 minutes. That makes it possible to ensure that the double twist is always recent when the first hauling step 11 is performed, namely that it will disappear during hauling before the immersed twist enters the guide device. This method makes it possible to reduce the chances of crushing part of the fairing string as a result of the formation of a double twist. It makes it possible to keep the system in an operational condition without the slightest interruption.

Figure 1A:
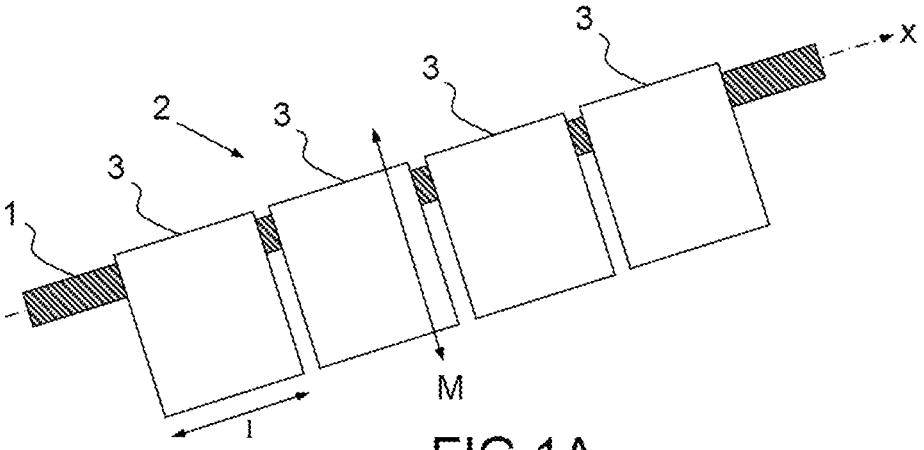
FIG. 1A already described depicts a portion of faired cable, FIG. 1B already described depicts an example of a cross section of a fairing element of a fairing in a plane M perpendicular to the axis of the cable and depicted in FIG. 1A, FIG. 2A, already described, depicts a faired cable, towed partially immersed from its immersed part as far as a guide pulley in a situation in which the cable does not experience a double twist.
Figure 1B:
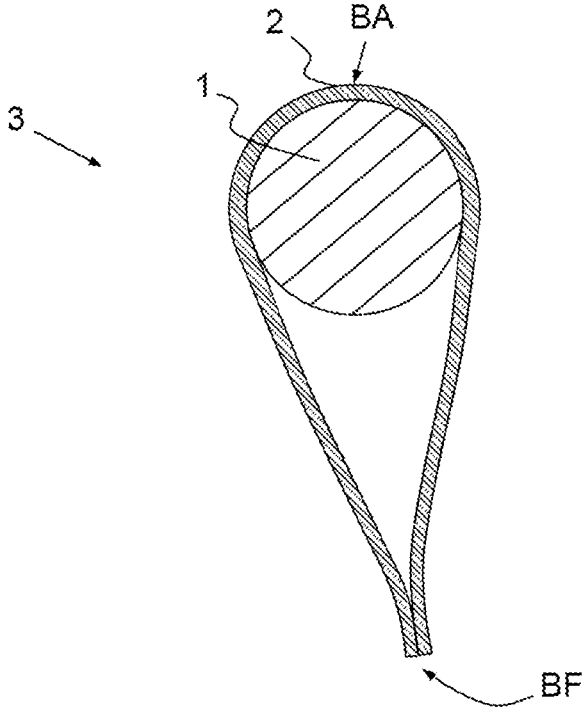
Figure 2A:
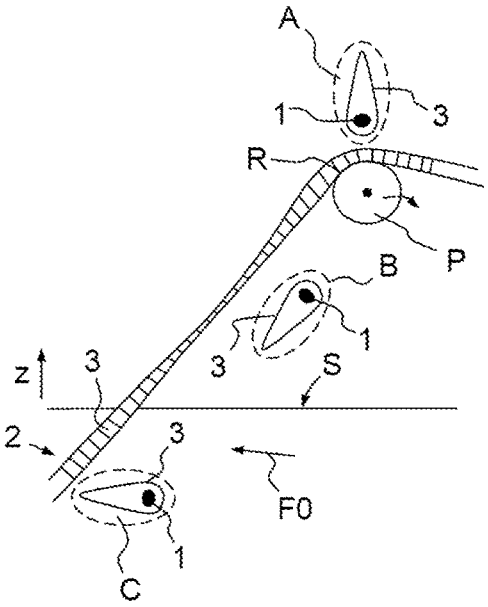
FIG. 2B depicts the cable of FIG. 2A in the same state of immersion (namely of winding-in and of paying-out) as in FIG. 2A, but experiencing a double twist.
FIG. 2C depicts the cable of FIG. 2A with the double twist of FIG. 2B in a configuration in which the cable has been paid out in relation to FIG. 2B.
FIG. 2D depicts the cable of FIG. 2A exhibiting the double twist of FIG. 2B in a configuration in which the cable has been hauled in in relation to FIG. 2B.
Figure 2B:
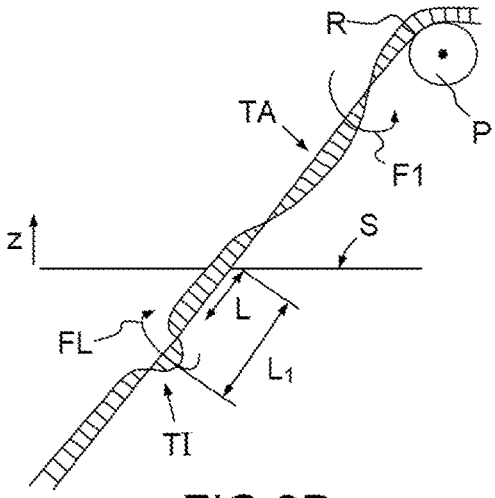
Figure 2C:
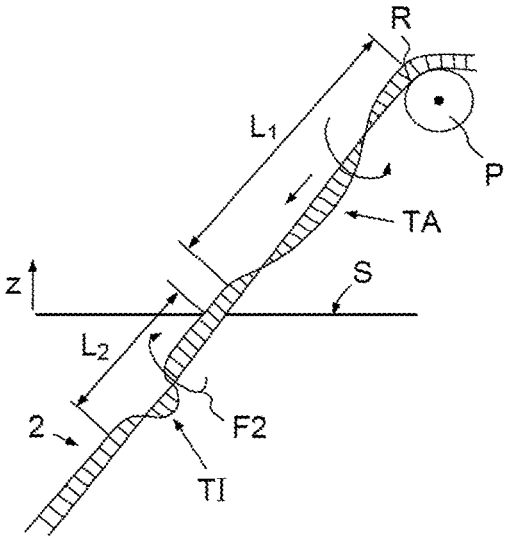
Figure 2D:
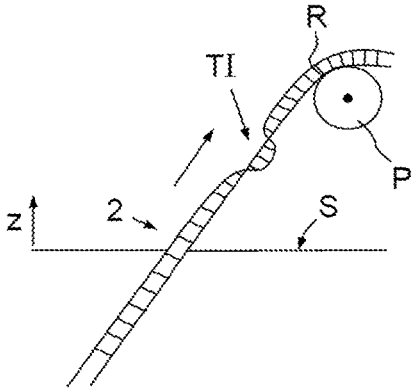

The first hauling step 11 comprises a lifting step 12 involving raising the tow point of the cable so as to bring the tow point to an altitude higher than the altitude it occupied at the moment of detection of the double twist, using a lifting device. The lifting device is, for example, the lifting device depicted in FIG. 1, in which case the articulated structure is pivoted from a low position into a high position in which the altitude of the cable tow point is higher than the altitude of the cable tow point in the situation in which the lifting device is in its low position. The travel of the cable tow point during the lifting step 12 is fixed and comprised between 1 and 2 m. It makes it possible to guarantee reabsorption of immersed twists extending to the travel of the lifting device. The advantage of the lifting operation is that the maneuver performed here is simpler than the hauling-in of the cable by winding the cable by means of the winch and, above all, is one which carries absolutely no risk of damaging the fairing if there is a long-standing double twist, because the cable does not progress toward the guide device. While this maneuver is simpler and safer, it will, however, be incapable of reabsorbing a double twist the immersed part of which is at a depth greater than the travel of the tow point between its high position and its low position.

Advantageously, the method according to the first embodiment comprises, when the double twist is not reabsorbed at the end of the raising step 12, a winding step 13 of winding the cable 1 in using the winch 5 until the double twist has been reabsorbed. This step is performed when the lifting device is in the high position.

As an alternative, the first hauling step 11 comprises only the step of winding the cable, for example, when there is no lifting device. As an alternative, the first hauling step comprises only the raising step.

The first hauling step 11 may be is performed in such a way as to wind in the cable by a predetermined length less than or equal to the altitude of the tow point in a calm sea state (namely when the axis of the boat is substantially horizontal in the Earth's frame of reference) plus 1 m. This is the minimum length of cable separating the tow point from the point at which the cable enters the water. This feature makes it possible to guarantee that a double twist situated just below the water surface does not enter the guide device. In the latter case and in the case where the hauling step comprises only the raising step, since the travel of the lifting device is fixed, paying-out of the cable is advantageously prevented once the double twist has been detected, thereby limiting the risks of increasing the depth of the immersed twist.

Figure 4:
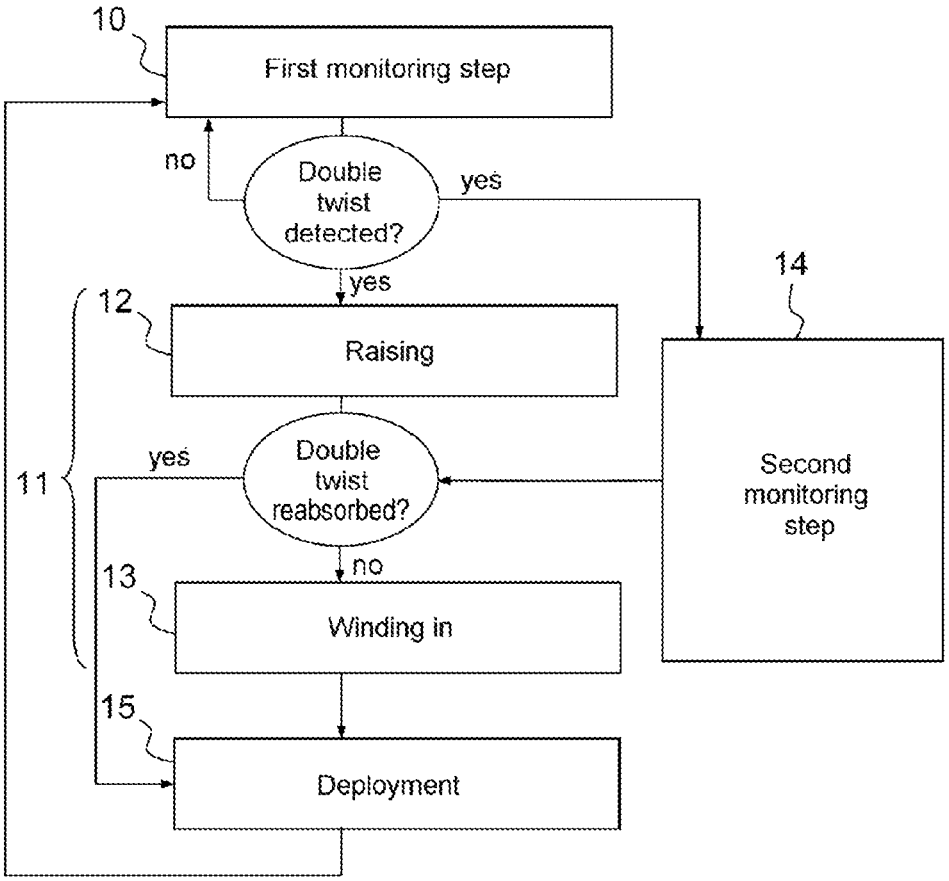
FIG. 4 is a block diagram of the steps of one example of a method according to a first embodiment.

In the example depicted in FIG. 4, the method comprises, for example although not necessarily, after the first hauling step 11, a deployment step 15 consisting in deploying the cable. This step consists in returning the tow point to the low position by means of the lifting device. As an alternative, the deployment step 15 consists in returning the cable to the state of deployment it had prior to the first hauling step. In this case, it further comprises a step of paying out the cable.

In the example depicted in FIG. 4, the method comprises a second monitoring step 14 making it possible to detect reabsorption of the twist. This step in fact needs to make it possible to detect reabsorption of the airborne twist. This step is carried out here continuously during the first hauling step. As an alternative, it could be carried out at regular time intervals or only at the end of the raising step and at regular time intervals or continuously during the cable winding step.

As an alternative, the method according to the first embodiment does not comprise this second fairing-monitoring step. For example, it is unnecessary when the first hauling step comprises only the raising step because the hauling-in of the cable by raising allows the tow point to be raised without the immersed twist moving closer to the guide device.

The method according to the first embodiment makes it possible to prevent double twists from passing through the guide device (namely before significant hauling-in of the cable) and makes it possible to avoid damage to the fairing as a result of the tightening over time of the immersed twist. By contrast, it has the disadvantage of requiring continuous or frequent monitoring of the fairing, and this requires a great deal of crew effort or requires a monitoring device that exhibits very good reliability in order to avoid false alarms associated with false detections of full twist and therefore needless haulings-in.

One example of a second embodiment of the invention which does not require constant or frequent monitoring of the fairing or which allows the use of a monitoring device that is not as reliable as in the first embodiment will now be described with reference to FIG. 5. In this second embodiment, the first monitoring step may be performed spasmodically or randomly during towing, or alternatively may be performed in certain predetermined situations only during towing.

In this case, in the method according to the invention, the starting point is the principle that when the cable 1 is to be maneuvered, there is no way of knowing whether the fairing is afflicted by a double twist. Now, we have seen that it is the hauling-in of the cable 1, and more particularly the winding of the cable around the winch, which may lead to the crushing of the fairing when the immersed part of the cable passes through the cable guide device. Therefore, in order to prevent that from happening, the method according to the second embodiment comprises a first step 20 of monitoring the fairing making it possible to detect a double twist of the fairing, which step is carried out before each second step of hauling the cable by a length L greater than or equal to a threshold length Ls equal to the altitude of the tow point with respect to the water surface, plus one meter. The first monitoring step 20 follows a cable towing step 19 during which the winch 5 blocks the winding-in/paying-out of the cable. It is, for example, performed after receiving an order to wind the cable in by a length L. When a double twist is detected, the second hauling step comprises a first step 21 of hauling of the cable.

The method advantageously comprises a second monitoring step 22 during the first hauling step 21. The second monitoring step 22 makes it possible to detect whether the double twist is reabsorbed, for example by detecting whether the airborne twist is reabsorbed, and to monitor the position of the immersed twist relative to the guide device. When the double twist is reabsorbed during the first hauling step 21, the first hauling step is followed by a final hauling step 24, comprised within the second hauling step, which consists in winding the cable in by means of the winch until the hauled length of cable reaches the length L. The winding of the cable may be continuous between the first hauling step and the final hauling step 24. It is advantageously performed at the same speed.

When the double twist is not reabsorbed during the first hauling step 21, and when the length L is such that it involves the immersed full twist passing through the guide device, the second hauling step advantageously comprises a third step 23 of hauling of the cable which consists in continuing the first hauling step as the immersed twist passes through the guide device. The cable is not paid out between the first hauling step and the final hauling step or between the third hauling step and the final hauling step.

Figure 5:
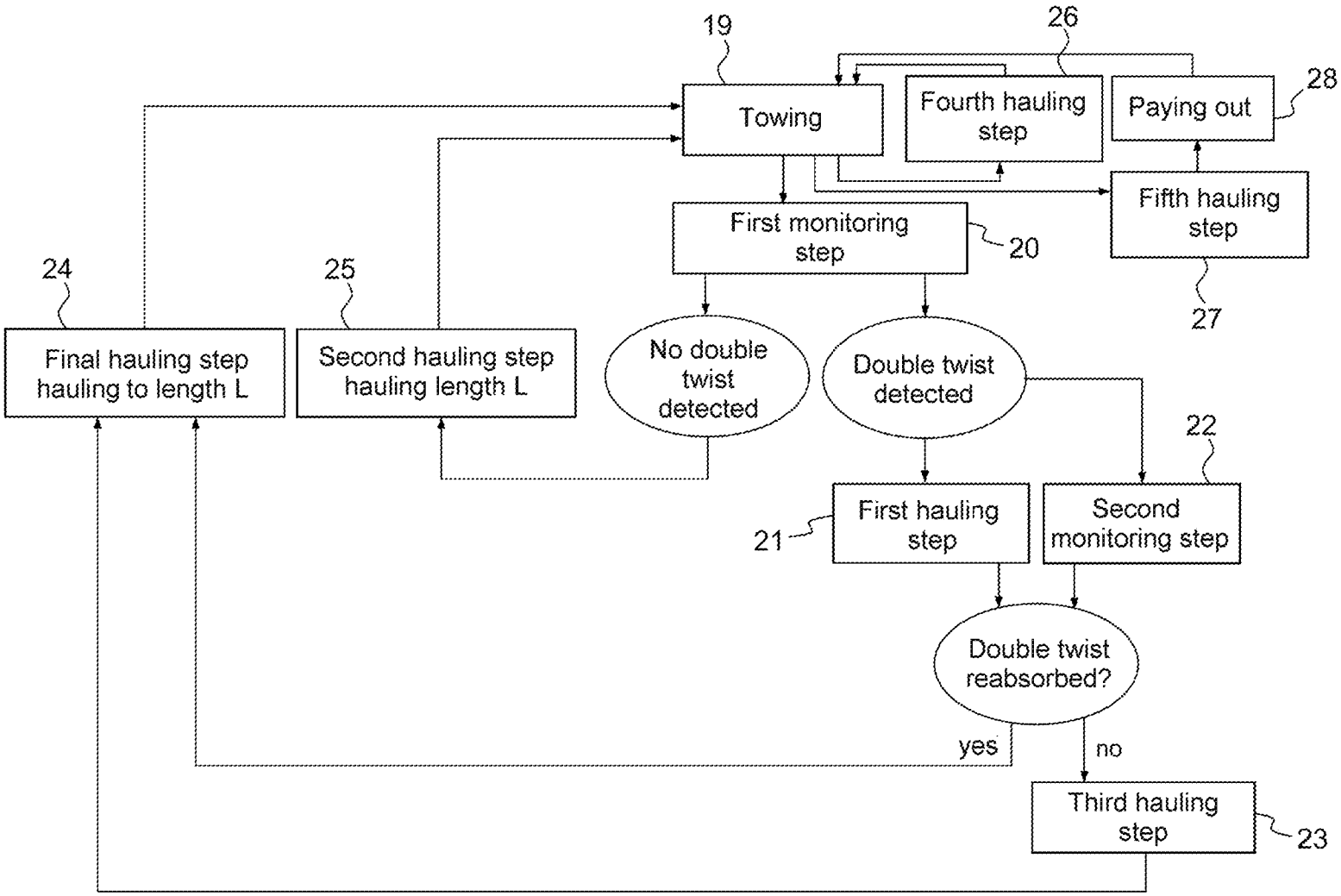
FIG. 5 is a block diagram of the steps of one example of a method according to a second embodiment.

In the embodiment of FIG. 5, the first hauling step 21 comprises a winding step performed by means of a winch. It is advantageously performed at the nominal operating speed of the winch. This nominal speed is conventionally comprised between 0.2 m/s and 1.0 m/s.

When the double twist is not reabsorbed during the first hauling step 21 it is then absolutely necessary to slow the hauling speed as much as possible and it is preferable to check carefully that each fairing element is straightening itself properly and engaging with the guides correctly. To that end, the first hauling step is performed at nominal speed and, for example, once the immersed twist is completely out of the water and before it enters the guide device, or when the immersed twist is partially out of the water, the third hauling step begins at a hauling speed lower than the nominal speed. This third hauling step may be manually or mechanically assisted so as to help the immersed twist to position itself correctly in the guide device, because the guide device acts like a shaper.

For example, between the first and the third hauling step the winding of the cable is continuous but the hauling speed used during the third hauling step is lower than the hauling speed used during the first hauling step. The third hauling step is performed for example at a speed which is lower by a factor of at least two than the speed at which the first hauling step is performed. The benefit of performing this step at a reduced speed is that it limits the risks of damage to the fairing as it passes through the guide device.

The same approach may be taken when the fairing elements experiencing the immersed twist are damaged. The benefit of this is that of avoiding additional damage as the immersed twist passes through the guide device. When there are breaks in the connection between the fairing elements, the first fairing element situated upstream of a break as seen from the winch will arrive at the guide device with the trailing edge oriented downward under the effect of gravity, and if the guide device is too narrow, or if hauling is too rapid, the fairing element will be unable of its own accord to orient itself with trailing edge uppermost. Now, because the cable presses against the trailing edge when the fairing element is pressing against the guide device, the fairing element jammed in the pulley will be crushed and damaged, leading to damage to all the following fairing elements. The reduced speed used during the third hauling step and the mechanical or manual assistance are highly advantageous in this case.

As an alternative, if the part of the fairing experiencing the immersed twist is damaged (fairing elements twisted or broken or breakage of the connection between fairing elements) then at the end of the first hauling steps, the method may comprise a step of repairing the fairing before implementing the third step.

When the double twist is not reabsorbed during the first hauling step, the hauling of the cable is advantageously halted until the double twist is reabsorbed as a result of the viscoelastic effect, before proceeding with the final hauling step 24. The part of the cable experiencing the immersed twist may be recovered manually and laid out on the deck between these steps in order to encourage the reabsorption of the double twist. After this wait, the system reverts to its nominal state and may once again be operated nominally. The hauling step consists in resuming the winding of the cable where it was stopped during the first hauling step until the length L has been wound in. Because the double twist has been reabsorbed and the fairing elements are in good condition, the final hauling step 24 can be performed at the nominal speed of the winch.

As an alternative, as in the first embodiment, the first hauling step may comprise a raising step. For that, the first hauling step begins with a first raising step and, if the double twist is not reabsorbed at the end of the raising step, a step of winding in the cable. The method comprises a deployment step at the end of the first hauling step or of the third hauling step. As an alternative, the first hauling step comprises only a winding step.

Advantageously, when no double twist is detected during the first monitoring step 20, the monitoring step is followed by the second hauling step 25, which may, for example, be performed without monitoring and continuously at the nominal speed of the winch.

Advantageously, but not necessarily, the method comprises, during the towing of the cable, fourth steps 26 of hauling the cable in, during which steps the cable is wound in by respective lengths less than the threshold length Ls, these being performed at time intervals of at least 20 minutes. In other words, the respective time intervals separating two successive fourth hauling steps are greater than or equal to 20 minutes. The cable is not paid out between two consecutive fourth hauling steps. The fourth hauling steps make it possible to remove any potential immersed twist there might be from the water blind (which means to say without mobilizing the crew to perform potential monitoring). Moreover, because the consecutive fourth hauling steps are spaced at least 20 minutes apart, if the double twist has come out of the water, even if this is a remanent double twist (which means to say one that is not reabsorbed as it leaves the water), it will have time to become reabsorbed before the next hauling step and will not enter the guide device. These fourth hauling steps therefore allow potential double twists that might have formed at the surface to be reabsorbed and make it possible to limit the risks of a double twist being detected at the time of the monitoring step prior to the hauling of the cable by a length greater than the length at least equal to, which means to say greater than or equal to, the threshold length Ls, and therefore to limit the probability of having to perform the double twist reabsorption procedure already described with reference to FIG. 5. The fourth hauling steps are advantageously performed at regular time intervals (which means to say that two successive hauling steps are separated by the same time interval). Advantageously, the lengths by which the cable is wound are the same for all the fourth steps. As an alternative, the time intervals and the wound lengths differ from one fourth step to another.

Advantageously, the method comprises, before at least one step 28 of paying out the cable, while the cable is partially immersed, a fifth hauling step 27 during which the cable is wound in by a hauling length less than the threshold length Ls. This step makes it possible to reabsorb recent double twists and makes it possible to limit the risks of old double twists appearing. Just like the preceding step, it makes it possible to limit the risks of a double twist being detected at the time of the first monitoring step.

The fourth hauling steps are performed at respective time intervals at least equal to 20 minutes for at least a predefined period chosen from a first period and at least one second period. The first period is a period extending from the start of towing 19 to the first monitoring step. A second period is a period extending between the end of a second hauling step and the start of the first monitoring step that follows said second hauling step.

The fifth hauling step is performed before a paying-out step performed at least during at least one other predefined period chosen from a first period and at least one second period. Advantageously, the fifth step is performed before each paying-out step performed during at least one other predefined period chosen from a first period and at least one second period.

In both embodiments, the first hauling step is performed following detection of a double twist. The method has no step of paying out the cable between the moment the double twist is detected and the performance of the first hauling step.

The steps of monitoring to detect a double twist, to detect the reabsorption of a double twist and to monitor the distance separating the immersed twist from the guide device may be carried out by visual inspection by the crew. This is because the airborne twist is always visible to the crew of the ship as is the position of the immersed twist with respect to the guide device when this twist leaves the water. This is effective, but dependent on the attention of an operator. The chief disadvantage is that this ties up an operator who has to move around at the stern of the vessel, sometimes in difficult sea conditions and in what may be conditions of severely restricted visibility.

As an alternative, at least one monitoring step is performed by a monitoring device. This is particularly advantageous in the case of the first embodiment in which constant or frequent monitoring is required, and it makes it possible to reabsorb recent double twists and avoid the consequences of long-standing double twists.

The invention also relates to a device for handling a faired cable towed by a ship. The device is able to implement the method according to the invention. The device comprises a monitoring device making it possible to detect whether the fairing is experiencing a double twist around the cable comprising an immersed full twist and an airborne full twist.

The handling device further comprises a hauling device allowing the first hauling step to be performed. In other words, the hauling device allows the cable to be hauled when a double twist is detected so that the immersed full twist at least partially leaves the water and does not enter the guide device.

For preference, the monitoring device is configured to implement the monitoring step or steps and notably the first monitoring step.

The monitoring device comprises for example an image sensor installed in such a way as to capture images of the cable recurringly, and an image processing device allowing a double twist in the cable to be detected. As an alternative, it may comprise a capacitive detector extending within the fairing elements along the cable which becomes crushed and the capacitance of which varies as the fairing elements are twisted. The monitoring device for example comprises a computer receiving the capacitance from the detector and comparing it against a predetermined threshold. The double twist is for example detected when the capacitance of the detector exceeds a predetermined first threshold.

The monitoring device advantageously makes it possible to detect the disappearance of a double twist and possibly to monitor the distance between the immersed twist and the guide device. The disappearance of the double twist is detected for example when the capacitance of the detector drops below a second predetermined threshold which may, nonlimitingly, be the first threshold. Advantageously, the monitoring device is configured to detect the disappearance of a double twist and possibly to determine the distance between the immersed twist and the guide device.

The hauling device for example comprises a winch and possibly a lifting device as claimed hereinabove.

Advantageously, the handling device is configured to implement the method according to the invention. The monitoring device is configured to implement the monitoring step or steps of the invention. This implementation is performed at the desired moments described in the present patent application (at predetermined time intervals and/or before each second step of hauling by a length L greater than or equal to a predetermined length).

The handling device comprises a hauling system configured to implement the first hauling step when a double twist is detected by the monitoring device. The hauling system is advantageously configured to implement the other hauling step or steps according to the invention. The hauling steps are implemented at the desired moments described in the present patent application. The hauling system comprises the hauling device and an activation device or actuator making it possible to activate, or configured to activate, the first step of hauling the cable by means of the hauling device when the double twist is detected, and control means, or controller, making it possible to control, or configured to control, the hauling step or steps and notably the first step of hauling the cable so that the immersed full twist at least partially leaves the water and does not enter the guide device. The control device for example comprises a command device allowing the hauling device to be controlled in such a way as to perform the first hauling step. The controller may be the actuator. To this end, the monitoring device is advantageously configured in such a way as to allow the second monitoring step to be implemented, or configured in such a way as to implement the second monitoring step, which means to say as to detect the disappearance of a double twist and/or to detect that an immersed double twist has left the water and/or as to compare the position of the immersed double twist with that of the guide device. The controller receives the information from the monitoring device.

As an alternative, the handling device comprises an alert device allowing an operator to be alerted when a double twist is detected. Advantageously, the alert device is configured to alert the operator when a double twist is detected. The operator then actuates and controls the hauling device in such a way as to perform the first hauling step. The second monitoring step is then, for example, performed by visual inspection. The invention also relates to a cabled system comprising a faired cable and a handling device according to the invention.

The invention claimed is:

1. A method for handling a cable that is faired by means of a fairing, said cable being towed by a ship on board which is there is carried a winch allowing the faired cable to be wound in and paid out through a faired-cable guide device, the method comprising:

a first step of monitoring the cable, making it possible to detect whether the fairing is experiencing a double twist around the cable comprising an immersed full twist and an airborne full twist, and, when a double twist is detected, a first step of hauling in the faired cable, during which step the faired cable is hauled in, the first hauling step being carried out in such a way that the immersed full twist at least partially leaves the water and does not enter the guide device.

2. The method for handling a faired cable as claimed in claim 1, in which the first hauling step comprises a step of raising the cable, during which step the tow point of the cable is raised using a lifting device carried on board the ship.

3. The method for handling a faired cable as claimed in claim 1, in which, when the double twist is not reabsorbed at the end of the raising step, the method comprises a step of winding the cable in using a winch carried on board the ship.

4. The method for handling a faired cable as claimed in claim 1, in which the first monitoring step is performed constantly or is repeated at time intervals shorter than a threshold duration ds at most equal to 10 minutes.

5. The method for handling a faired cable as claimed in claim 4, in which a duration d separates the detection of the double twist and the start of the first step of hauling of the cable, the sum of the threshold duration ds and of the duration separating the performance of the first monitoring step at the moment of detection and the previous implementation of the first monitoring step is at most equal to 15 minutes.

6. The method for handling a faired cable as claimed in claim 4, in which the first hauling step is performed at least until the detected double twist has been reabsorbed.

7. The method for handling a faired cable as claimed in claim 1, comprising a first monitoring step making it possible to detect a double twist of the fairing which step is performed before each second hauling step during which the cable is wound in, by means of the winch, by a length L greater than or equal to the sum of 1 meter and the altitude separating the tow point from the water surface.

8. The method for handling a faired cable as claimed in claim 7, in which the first hauling step is performed at least partially by means of a winch at the nominal speed of the winch, the method comprising, when the double twist is not reabsorbed during the first hauling step, and if the winding-in of the length L of cable involves the immersed twist passing through the guide device, a third step of hauling the cable during which step the immersed twist belonging to the detected double twist passes through the guide device, the third hauling step being performed by means of the winch at a hauling speed lower than the nominal speed.

9. The method for handling a faired cable as claimed in claim 8, in which the third hauling step is manually or mechanically assisted so as to position the fairing correctly in the guide device.

10. The method for handling a faired cable as claimed in claim 7, in which the hauling of the cable is halted at the end of the first hauling step until the double twist is reabsorbed.

11. The method for handling a cable as claimed in claim 7, in which, when the double twist is reabsorbed during the first hauling step, the first hauling step is followed by a final hauling step performed by means of the winch at the nominal speed of the winch until the length of cable wound in by means of the winch reaches the length L.

12. The method for handling a cable as claimed in claim 1, comprising, when no double twist is detected during the first monitoring step, a second step of hauling the cable in by a length L, which step is performed by means of a winch at the nominal speed of the winch.

13. The method for handling a cable as claimed in claim 7, comprising a second monitoring step performed during the first hauling step and making it possible to detect the reabsorption of the double twist and to monitor the position of an immersed full twist relative to the guide device.

14. The method for handling a cable as claimed in claim 7, comprising fourth steps of hauling the cable during which steps the cable is wound in by respective lengths less than the sum of 1 meter and the altitude separating the tow point from the water surface, the fourth hauling steps being performed at respective time intervals greater than or equal to 20 minutes at least during a predefined period, the cable not being paid out between two consecutive implementations of the fourth step.

15. The method for handling a cable as claimed in claim 7, comprising a fifth hauling step consisting in winding the cable in by a length less than the sum of 1 meter and the altitude separating the tow point from the water surface, to the length prior to at least one step of paying out the cable.

16. The method of handling a cable as claimed in claim 15, in which the first hauling step is performed by means of a hauling device, said hauling device being activated automatically when the monitoring device detects a double twist.

17. A device for handling a cable that is faired by means of a fairing and towed by a ship on board which there is carried a winch allowing the faired cable to be wound in and paid out through a faired cable guide device, said device comprising a monitoring device making it possible to detect whether the fairing is experiencing a double twist around the cable comprising an immersed full twist and an airborne full twist, and a hauling device allowing the cable to be hauled in when a double twist is detected so that the immersed full twist at least partially leaves the water and does not enter the guide device, this device being configured to implement the method as claimed in claim 1, the monitoring device being configured to detect whether the fairing is experiencing a double twist about the cable comprising an immersed full twist and an airborne full twist and the hauling device being configured to implement the first hauling step when a double twist is detected by the monitoring device.

18. The device for handling a cable as claimed in claim 17, comprising an actuator configured to activate the hauling of the cable by means of the hauling device when a double twist is detected by the monitoring device, and a controller allowing the hauling of the cable by means of the hauling device to be controlled in such a way that the immersed full twist at least partially leaves the water and does not enter the guide device.

* * * * *